US005359967A

United States Patent [19]

Carter et al.

[11] Patent Number: 5,359,967

[45] Date of Patent: Nov. 1, 1994

[54] COMBINED THERMAL AND FUEL $NO_x$ CONTROL UTILIZING FURNACE CLEANLINESS AND STOICHIOMETRIC BURNER COMBUSTION

[76] Inventors: Hudson R. Carter, 104 Millspring Dr., Forest, Va. 24551; John T. Huston, 823 Reese Ave., Lancaster, Ohio 43130

[21] Appl. No.: 76,030

[22] Filed: Jun. 15, 1993

[51] Int. Cl.[5] ..... F22B 37/18

[52] U.S. Cl. ..... 122/379; 122/504; 134/18; 134/56 R; 165/95

[58] Field of Search ..... 122/379, 504; 165/1, 165/95; 236/14; 134/18, 56 R, 57 R, 58 R

[56] References Cited

U.S. PATENT DOCUMENTS 4,475,482 10/1984 Moss et al. ..... 122/379

5,181,482 1/1993 Labbe et al. ..... 122/379 X

*Primary Examiner*—Edward G. Favors

*Attorney, Agent, or Firm*—R. J. Edwards; V. R. Matas

[57] ABSTRACT

A method for controlling nitrogen oxides ($NO_x$) levels in a gas produced by a fossil fuel fired unit comprises establishing an optimum gas temperature range for the unit and monitoring a gas temperature of the unit. The heat exchanger surfaces of the unit are then cleaned until the monitored gas temperature is within the optimum gas temperature range. An optimum fuel combustion rate range is also established for the unit and a fuel combustion rate of the unit is monitored. Air is provided to the unit until the monitored fuel combustion rate is within the optimum combustion rate range.

13 Claims, 7 Drawing Sheets

BURNER TEST CASE 1

POWER: 100%
INNER VANE POSITION 2
OUTER VANE POSITION 4

$NO_x$: 220 PPM
CO: 37 PPM
$CO_2$: 15.03%
$O_2$: 3.46%

BURNER TEST CASE 2

POWER: 100%
INNER VANE POSITION 2
OUTER VANE POSITION 3

$NO_x$: 228 PPM
CO: 37 PPM
$CO_2$: 15.45%
$O_2$: 2.68%

COMBINED THERMAL AND FUEL $NO_x$ CONTROL UTILIZING FURNACE CLEANLINESS AND STOICHIOMETRIC BURNER COMBUSTION

FIELD AND BACKGROUND OF THE INVENTION

The present invention relates in general to reducing $NO_x$ levels in power plant emissions and, in particular, to a new and useful system and method for providing combined thermal and fuel $NO_x$ control in a power plant utilizing furnace cleanliness and stoichiometric burner combustion.

In the power plant field, $NO_x$ formation from combustion processes using air has two components, thermal $NO_x$ and fuel $NO_x$. The relative contribution of each depends primarily on the nitrogen content of the fuel and the temperature of the combustion process. $NO_x$ is produced at high temperatures by oxidation of the nitrogen from the combustion air (thermal $NO_x$) and oxidation of the nitrogen from the fuel (fuel $NO_x$). Thermal $NO_x$ is formed by gas-phase chain reactions between $O_2$ radicals and $N_2$.

$NO_x$ collectively refers to nitric oxide (NO), nitrogen dioxide ($NO_2$) and nitrous oxide ($N_2O$). NO is the only nitrogen oxygen compound that can form, be stable, and exist in significant quantities in the high temperature portions of a utility boiler system.

Thermal $NO_x$ is NO derived from the heating of air. The three equations of the Zel'dovich mechanism illustrate the derivation of thermal $NO_x$.

The first equation:

$$O_2+M<->O+O+M \quad (1)$$

shows the diatomic oxygen in the presence of a reaction medium M breaks down to or is combined from oxygen radicals. The forward reaction rate is proportional to temperature and on the order of 10 $ft^3$/lb-mol-hr at 2300° F., 100 $ft^3$/lb-mol-hr at 2500° F., and 1000 $ft^3$/lb-mol-hr at 2700° F. The reverse reaction rate is constant on the order of $10^{14}$ $ft^3$/lb-mol-hr regardless of temperature.

If we use these forward and reverse reaction rate constants in the following equation for a reversible reaction:

A+B<->C+D with forward rate k1 and reverse rate k2 at equilibrium: k1[A][B]=k2[C][D]

Then, for this reaction proportionally few oxygen radicals exist relative to concentration of diatomic oxygen even at high temperatures. Also, since k1 increases with temperature and k2 does not, as temperature increases for a constant concentration of diatomic oxygen the radical concentration will increase.

The next equation:

$$N_2+O<->NO+N \quad (2)$$

shows that diatomic nitrogen in the presence of oxygen radicals will combine with some of those radicals to form NO and radical N.

The forward reaction rate constant for this equation is also proportional to temperature but on the order of $10^6$ $ft^3$/lb-mol-hr at 2600° F. and $10^7$ $ft^3$/lb-mor-hr at 2900° F. The reverse reaction rate is constant with temperature and on the order of $10^{15}$ $ft^3$/lb-mol-hr.

Although the reverse reaction rate constant is much higher than the forward rate constant, the high concentration of diatomic nitrogen relative to NO and N will force the reaction forward as long as sufficient oxygen radicals are present. At temperatures of 2700–2800 the first equation produces a sufficient oxygen radical concentration to drive this second reaction forward.

From these constants, the NO formation rate is also faster than the oxygen radical formation rate of the first equation. This means that the formation rate of NO is limited by the rate of formation of oxygen radicals which is proportional to temperature.

The third equation:

$$O_2+N<->NO+O \quad (3)$$

shows that if nitrogen radicals are present with diatomic oxygen, NO can be formed. The forward reaction rate is slightly temperature dependent and is on the order of $10^{14}$ $ft^3$/lb-mol-hr at 2600° F. The reverse reaction rate is more temperature dependent but on the order of only $10^9$ $ft^3$/lb-mol-hr at 2600° F. and $10^{10}$ $ft^3$/lb-mol-hr at 3000° F. Both the forward reaction rate constant being higher than the reverse rate constant and the relatively diatomic oxygen concentration drive this reaction forward where N radicals exist.

Finally, by comparing the second and third equations, the reverse reaction rate of the second equation is on the order of $10^{15}$ $ft^3$/lb-mol-hr compared to the forward reaction rate of the last equation of $10^{14}$ $ft^3$/lb-mol-hr. This alone suggests that a nitrogen radical would preferentially combine with NO to form diatomic nitrogen and oxygen radicals over combining with diatomic oxygen to form NO. However, the difference in reaction rates constants is only on the order of 10 while the reaction of diatomic oxygen concentration to the concentration of NO will normally greatly exceed this factor. Therefore, NO is formed by both the second and third equations in the heating of air.

The other major mechanism for the formation of $NO_x$ is derived form the nitrogen in the fuel. Although oils and coals typically contain only 0.5 to 2% of nitrogen by weight, it is generally believed that fuel $NO_x$ contributes between 50 and 80% of the total $NO_x$ generated in unstaged firing applications.

The formation of fuel NO can be further divided into two paths dependent on the location of the nitrogen undergoing reaction: 1. volatile nitrogen which is released with the volatile matter of the coal, and 2. char nitrogen which remains with the char after devolatilization is complete. FIG. 1 shows the relative percentages of thermal, volatile based fuel, and char based fuel $NO_x$ generated versus heat rate and versus stoichiometry ratio for unstaged combustion (FIG. 1A).

The nitrogen in fuels is usually bound in the form of attached ammonia ($NH_3$) or pyradine ($C_5H_5N$). Once the fuel is heated it breaks down into nitrogen bound intermediates:

fuel+heat->HCN, CN, OCN, HNCO, $NH_3$, $NH_2$, NH, or N.

These intermediates are released in the volatile mass leaving behind char. Then in the presence of oxygen these intermediates react forming NO as a product:

$$HCN+O_x->NO+CO+\ldots$$

$$NH_3+O_x->NO+\ldots$$

In the absence of sufficient oxygen these intermediates however react with any NO present to form diatomic nitrogen:

$$HCN+NO->N_2+\ldots$$

$$NH_3+NO->N_2+H_2O$$

Experimental work has indicated that the conversion of HCN and $NH_3$ was dependent on the local temperature and oxygen radical concentrations. The primary factor affecting fuel nitrogen conversion is the oxygen concentration. The formation rate constants are not as temperature dependent as the formation and reaction of oxygen radicals of the Zel'dovich mechanism for thermal $NO_x$.

The char which remains after the volatile matter is released is high in carbon, low in oxygen and hydrogen, and contains some nitrogen, sulfur, and other minerals. Carbon and nitrogen oxidization of these char particles is heterogeneous as oxygen comes into contact with the hot particle surfaces:

$$O_2+N->NO+O$$

The conversion efficiency of char nitrogen is generally less than 20%, which is lower than for volatile nitrogen. This may relate to the known capability of carbon to reduce NO:

$$NO+C_x->CO+N_2$$

Federal regulations, namely, the Clean Air Act Amendments of 1990, Titles I and IV, mandate $NO_x$ reduction from stationary sources. The impact on utilities is that by the year 2000, more than 200,000 system MW must be retro-fitted with low-$NO_x$ systems. Title IV (acid rain) requires the use of low $NO_x$ combustion technology and Title I (ozone non attainment) requires RACT (reasonable, available control technology) to reduce $NO_x$.

U.S. Pat. No. 4,408,568 to Wynnyckyj, et al. discloses a furnace wall ash monitoring system utilizing flux detectors. Heat fluxes are detected and converted to electrical signals indicating detected flux values which are displayed by traces on a charge plotted by an electronic recorder. These signals indicate the degree of furnace fouling and are used as a basis for sootblower actuation.

U.S. Pat. No. 4,488,516 to Bueters, et al. discloses a sootblower system in which sootblowers are selectively operable in response to the local heat transfer rate from the hot combustion products to the walls of the furnace sensed by flux meters. Sensed transfer rates are compared to a set point value. An output activates an indicating means to alert the operator and to automatically activate a sootblower. Display means is provided which indicates sootblower status and the relative output (74) of each flux meter.

U.S. Pat. No. 4,599,975 to Reeve, et al. teaches the use of a probe tube positioned in flue gas to measure temperature and thereby determine the rate of build-up of furnace deposits. This information is used by the operator to control boiler operation. The probe system is provided along with a deposit monitoring device to periodically activate a data acquisition system which provides a visual display of deposit accumulation rate and flue gas temperature.

U.S. Pat. No. 4,552,098 to Wynnyckyj, et al. discloses the use of radiation pyrometers which determine temperature drop across the heat exchanger tubes. Calculations are made of a fouling factor to actuate sootblowers. Heat flux meters may also be used. Indications of an unevenly fouled tube bank may be displayed numerically or visually on a monitor screen.

SUMMARY OF THE INVENTION

The present invention pertains to a method for controlling nitrogen oxides ($NO_x$) levels in a gas produced by a fossil fuel fired unit. The method comprises establishing an optimum gas temperature range for the unit and monitoring a gas temperature of the unit. The heat exchanger surfaces of the unit are cleaned until the monitored gas temperature is within the optimum gas temperature gas range. The method also, comprises establishing an optimum fuel combustion rate range for the unit and monitoring a fuel combustion rate of the unit. Air is provided to the unit until the monitored fuel combustion rate is within the optimum fuel combustion rate range.

The present invention also pertains to a system for controlling $NO_x$ levels in a gas produced by a fossil fuel fired unit having heat exchanger surfaces wherein the system comprises burning means in the unit for burning the fuel at a combustion rate. Air means is included for providing air to the unit; and cleaning means is provided for cleaning the heat exchanger surfaces of the unit. The system also comprises monitoring means for setting an optimum combustion rate for the unit and for measuring the combustion rate produced by the burning means. The monitoring means communicates with the air means for adjusting the measured combustion rate within the combustion rate range by providing air to the unit. Also, the monitoring means sets an optimum gas temperature range for the unit and measures a gas temperature of the unit. The monitoring means also communicates with cleaning means for adjusting the gas temperature of the unit within the optimum gas temperature range by cleaning the heat exchanger surfaces of the unit.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

Figure 1:
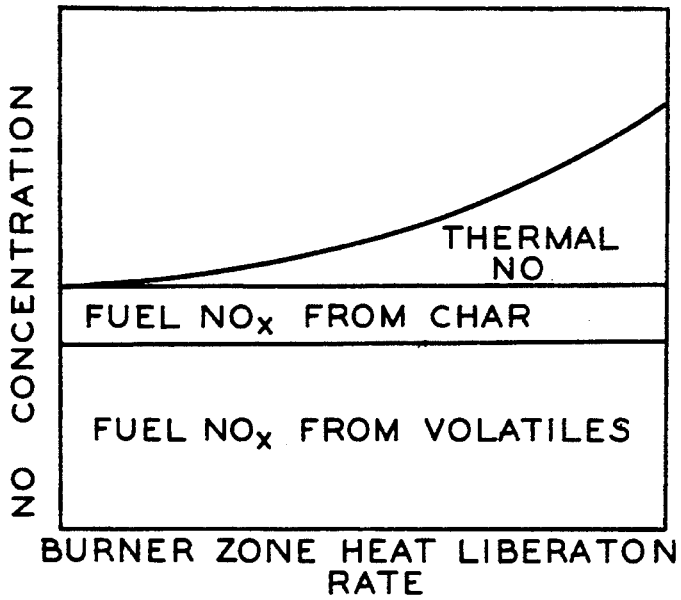
FIG. 1 is a graph illustrating $NO_x$ sources versus heat rate.
Figure 1A:
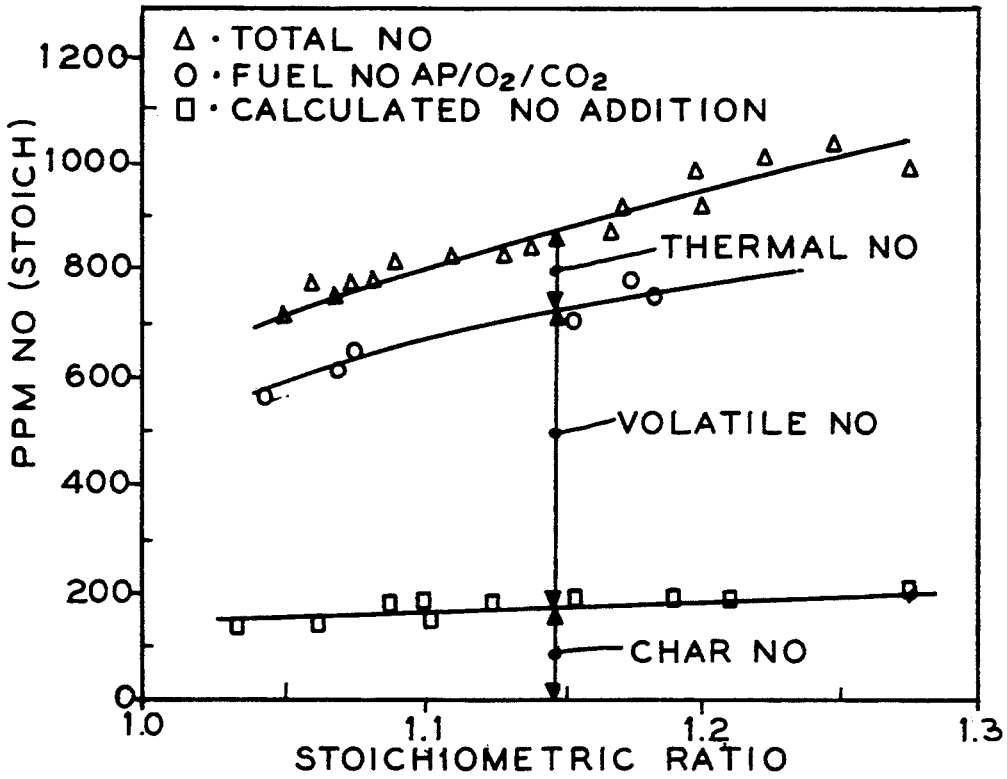
FIG. 1A is a graph illustrating $NO_x$ sources versus stoichiometry ratio for unstaged combustion.

The present invention allows for the reduction of $NO_x$ levels based on several principles listed below. Char nitrogen forms a constant NO dependent on coal characteristics which is unavoidable under practical combustion. This is because the reaction of char particles with oxygen is much slower than the oxidation of volatile matter. This makes it impossible to keep char particle combustion in an oxygen lean condition to preclude NO formation.

The remaining 60–80% of the fuel NO produced during unstaged combustion has been attributed to nitrogen released with volatile matter.

The total nitrogen volatized in the heating of coal is found to be more sensitive to temperature than the total mass evolved during pyrolysis. Thus, at higher temperatures an increase in the amount of nitrogen is evolved with the volatile matter during coal devolatilization. Since the conversion efficiency of fuel nitrogen to NO is higher for volatized nitrogen than it is for char nitrogen, the less volatized, the lower the fuel N to $NO_x$ conversion efficiency.

Principle 1: Lower temperatures at the point of coal devolatization reduce volatized nitrogen and lower the overall fuel N to $NO_x$ conversion efficiency.

The second principle arises from the fact that in the absence of oxygen the nitrogen bound intermediates react with any NO present to form diatomic nitrogen. This is the principle upon which the technique of staging combustion rests.

Principle 2: If coal devolatization occurs in an oxygen lean environment, then HCN and $NH_3$ form $N_2$ rather than NO and react with NO to reduce it to $N_2$.

The third principle uses the requirement that for the second equation of the Zel'dovich mechanism to be driven forward requires an oxygen radical concentration corresponding to a temperature greater than 2700° F.

Principle 3: If the oxygen lean condition can be extended as long as temperatures are above 2700° F., then sufficient oxygen radical concentration will not be formed to drive the Zel'dovich mechanism's NO formation equation forward.

The fourth principle is based on the temperature dependence of the rate constant of oxygen radical formation, and the concept that for moving particles residence time is related to flame volume. As the time available for reaction at high temperature increases, the NO concentration can be expected to increase.

Principle 4: In oxygen rich conditions reduce temperatures in as minimum a volume or time as possible to 2700° F. to minimize total thermal $NO_x$ produced.

The major contributor of $NO_x$ is volatized fuel $NO_x$. The most significant parameter in volatized fuel $NO_x$ formation mechanisms is oxygen concentration at the location where the nitrogen bound intermediate constituents are reacting. The location can be assumed to be near the location of coal devolatilization as temperatures high enough for devolatilization provide sufficient activation energy for the reactions. If oxygen concentration can be reduced for the majority of the reactions, while maintaining temperature to cause devolatilization, the resulting nitrogen produce will be diatomic nitrogen rather than NO. Since a given coal particle will principally absorb heat by radiation, the production of a large surface area, yet small volume, and highly radiant flame between the fuel source of the air source, will create the desirable condition. This concept of staged combustion is implemented on cell type low $NO_x$ burners by the creation of a shell of flame around the fuel. The same concept is implemented on register based low $NO_x$ burners by formation of a diffusion flame front with low stoichiometry ration and then introducing additional air above after the nitrogen intermediates have reacted. Laboratory tests have indicated that the optimum burner stoichiometric ratio is 0.8.

The second highest producer is thermal $NO_x$. The most significant factor in the thermal $NO_x$ formation mechanism is temperature. The highest temperature is produced in a flame of stoichiometry ratio near one. Staging combustion reduces peak temperatures. Then, subsequent controlled admission of air in a reactor which absorbs heat (boiler) will allow the temperature to be controlled as combustion is completed. Thus, a low thermal $NO_x$ producing flame of a given heat transfer rate would ideally consist of a flame of low peak temperature volume product, a rapid decrease in temperature below 2700° F., and a larger volume at or near 2700° F. to maintain total heat release rate. This is implemented by rapidly reducing temperatures after the initial reducing zone by flow dynamics. This concept is the basis for recirculation zones (drawing cooler exhaust back into flame) as well as the distribution control of air in staged combustion.

According to the present invention, $NO_x$ is controlled by furnace cleanliness management and is based on controlling gas side temperatures to minimum acceptable values by enhancing furnace heat absorption. In many coal and oil-fired boilers, this is accomplished by prudent selection, location and effective operation of furnace cleaning devices. As previously described thermal $NO_x$ is a major contributor to overall $NO_x$ emission levels. The most significant factor in the formation of thermal $NO_x$ is temperature. Furnace cleanliness management primarily reduces thermal $NO_x$ by reducing furnace gas side temperatures.

Heat transfer to the tube side fluid in the furnace of utility boilers is predominately radiation (90% of total heat transfer). As a furnace heat transfer surface becomes dirty, flame temperatures must increase to maintain constant load conditions.

$$R=\epsilon\tau(T_1^4-T_2^4)$$

Where:

$R$ = Net rate of radiation energy transfer $\epsilon$ = Effective Emissivity $\tau$ = Constant $T_1$ = Flame Temperature $T_2$ = Furnace Wall Temperature The above equation is used to estimate the effect of changing cleanliness conditions on gas side temperatures. For a constant heat transfer rate and the assumptions noted below, the change in flame temperature with variations in furnace cleanliness can be estimated.

Assumptions:

$T_{1c}$=3000° F. (flame temperature with clean furnace wall)

$\epsilon_c$=0.7 (effective emissivity with clean furnace wall)

$T_{2c}$=750° F. (wall temperature with clean furnace wall)

$T_{2d}$ 750° F. (wall temperature with dirty furnace wall)

$\epsilon_d$=0.4 (effective emissivity with dirty furnace wall)

$T_{1d}$=(flame temperature with dirty furnace wall)

Radiation heat transfer is related to temperatures to the fourth power, therefore, for an order of magnitude estimate, $T_2$ can be eliminated since the value when raised to the fourth power is small compared to $T_1$ to the fourth power. Therefore, the equation for estimating the change in flame temperature can be simplified to:

$$T_{1d}=(E_c/E_d)^{\frac{1}{4}}T_{1c}$$

$T_{1d}$ based on the above equation is 3500° F. or a 500° F. increase compared to the temperature required with a clean furnace. The total change in furnace temperature would not be seen since convection pass heat transfer surfaces would provide part of the added heat transfer requirement.

Figure 2:
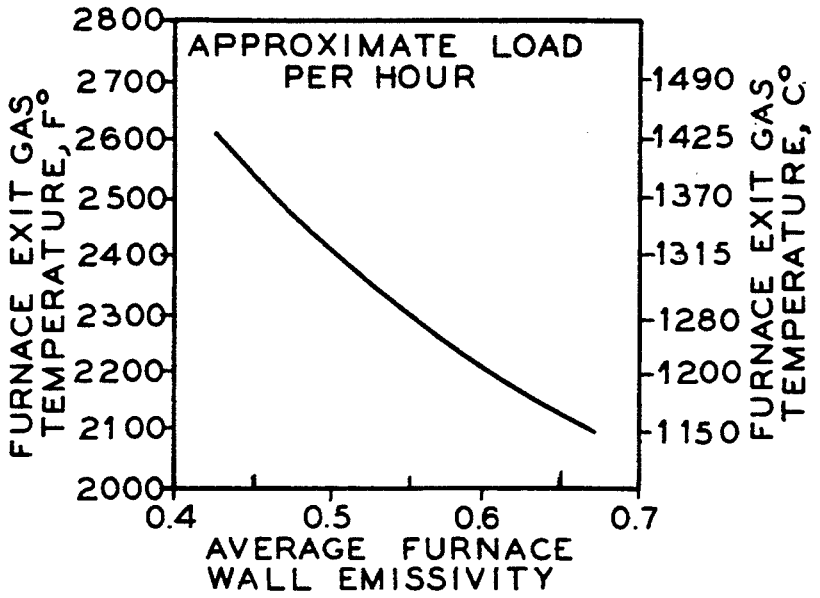
FIG. 2 is a graph illustrating furnace emmissity versus furnace exit gas temperature.

Test results have shown effective wall emittance variations from 0.2 to 0.8 are possible in coal fired units. FIG. 2 illustrates the magnitude of furnace exit gas temperature (FEGT) change that can occur in a 500 MW boiler at full load conditions as furnace wall emittance varies. A 500° F. increase FEGT can result with a change in the furnace emittance of 0.4 to 0.7.

Thermal $NO_x$, which occurs only at high temperatures, is formed by the reaction of oxygen and nitrogen found in the air. Generation of thermal $NO_x$ is exponentially dependent on temperature. The $NO_x$ emission at 2700° F. is over 40 times greater than at 2200° F.

FEGT can be controlled by a proper complement and operation of furnace cleaning equipment. Therefore, fossil fuel fired boilers with a significant thermal $NO_x$ component and the need for furnace heat transfer surface cleaning can realize significant reductions in $NO_x$ emissions by furnace cleaning management.

Figure 3:
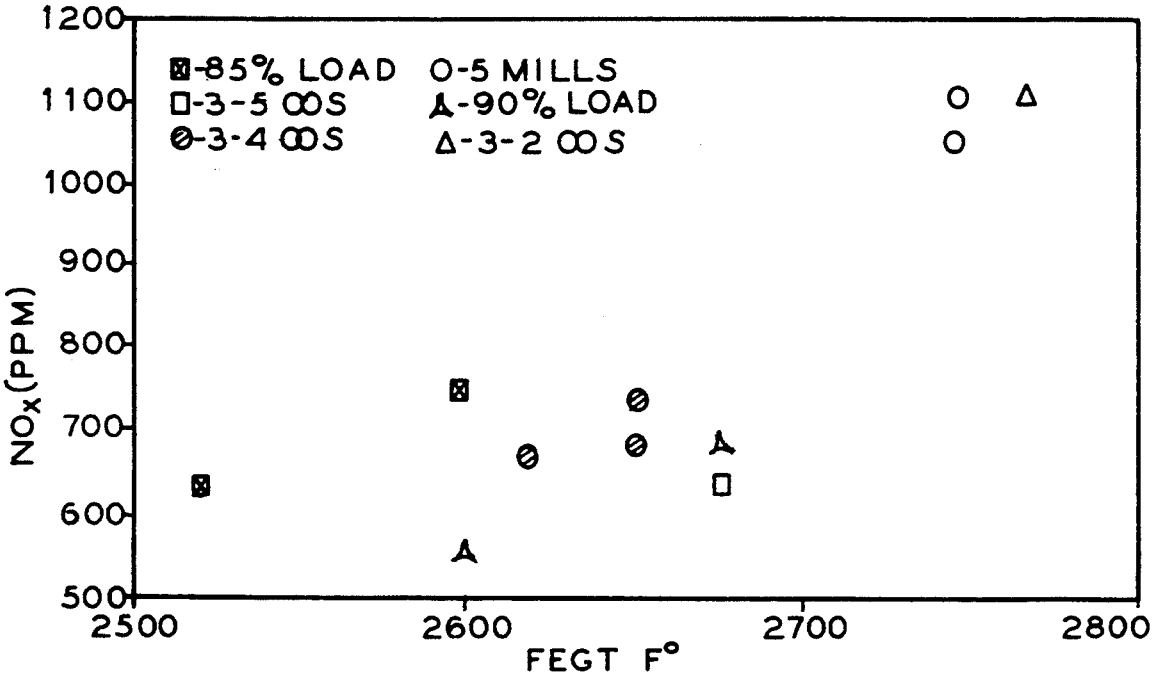
FIG. 3 is a graph plotting the effect of furnace exit gas temperature on an $NO_x$.

FIG. 3 illustrates the measured variation in $NO_x$ emission with changes in FEGT. These results were obtained on a large (>500 MW) wall fired unit burning bituminous coal. The variation in $NO_x$ resulted from changes in the operating frequency of furnace wall cleaning devices. A $NO_x$ reduction of up to 30% was measured corresponding to a FEGT change of 100° F.

FEGT can be controlled to minimum acceptable levels by enhancing furnace heat absorption, thereby reducing $NO_x$. An integrated system of an on-line FEGT sensor, furnace cleaning devices and controls can effectively manage the cleaning process to realize $NO_x$ reductions of more than 30%.

Figure 4:
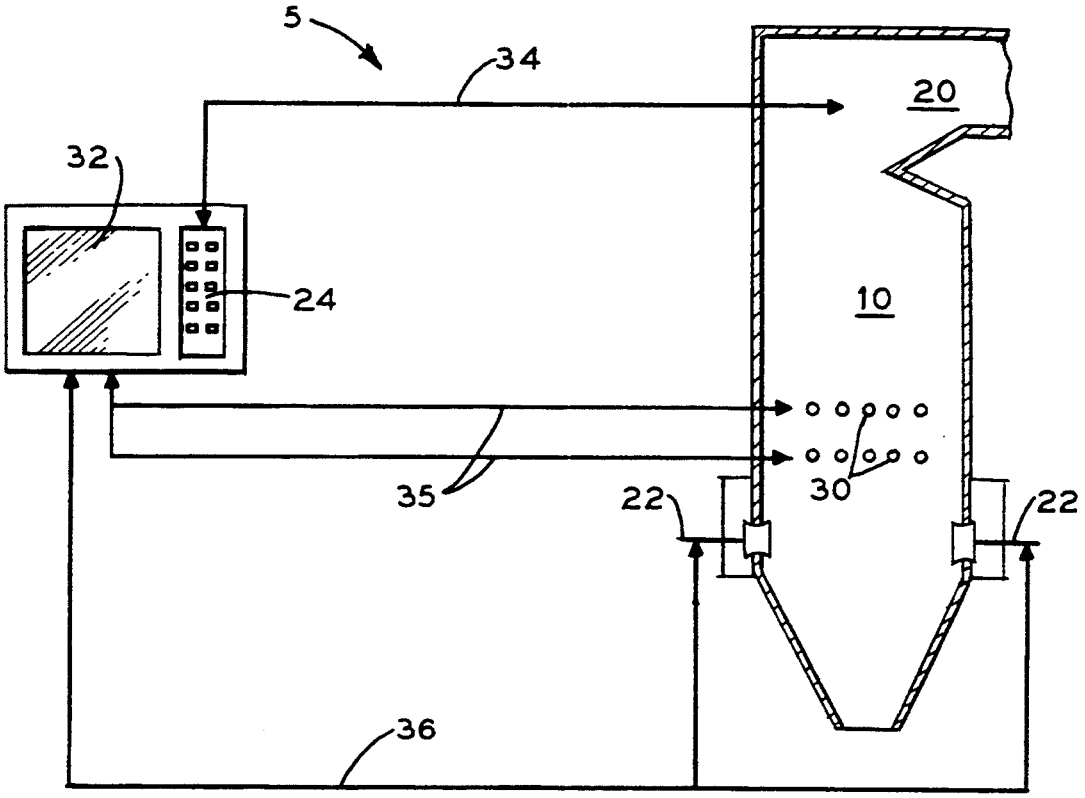
FIG. 4 is a schematic view of a system according to the present invention.

FIG. 4 illustrates a system 5, according to the present invention, for improving furnace heat transfer, reducing FEGT and reducing $NO_x$ emissions. The system 5 comprises a unit or furnace 10 having a furnace exit gas temperature region 20 and cleaning means 30 such as water lances, and/or steam cleaning devices, and/or sootblowers, etc. The furnace 10 has burners 22 for combusting the fossil fuels within the furnace 10.

The system 5 also comprises a control system 32 operatively connected to the furnace exit gas temperature 20 at line 34 and the cleaning means 30 at lines 35 for monitoring and controlling both the furnace exit gas temperature 20 and the cleaning means 30. The control system 32 includes a gas temperature soft key pad 24 for effecting the gas temperature of the furnace 10. The control system also includes a main screen 32 for displaying the gas temperature and combustion rate for the system. The monitoring control system 32 is operatively connected to the burners 22 at line 36 for monitoring the combustion rate of the system 5 and for providing air to the furnace 10 through burners 22 for effecting the combustion rate.

According to the present invention, the integrated system 5 permits condition-based cleaning control in order to maintain the desired FEGT and thereby and an achievable $NO_x$ reduction.

Figure 9:
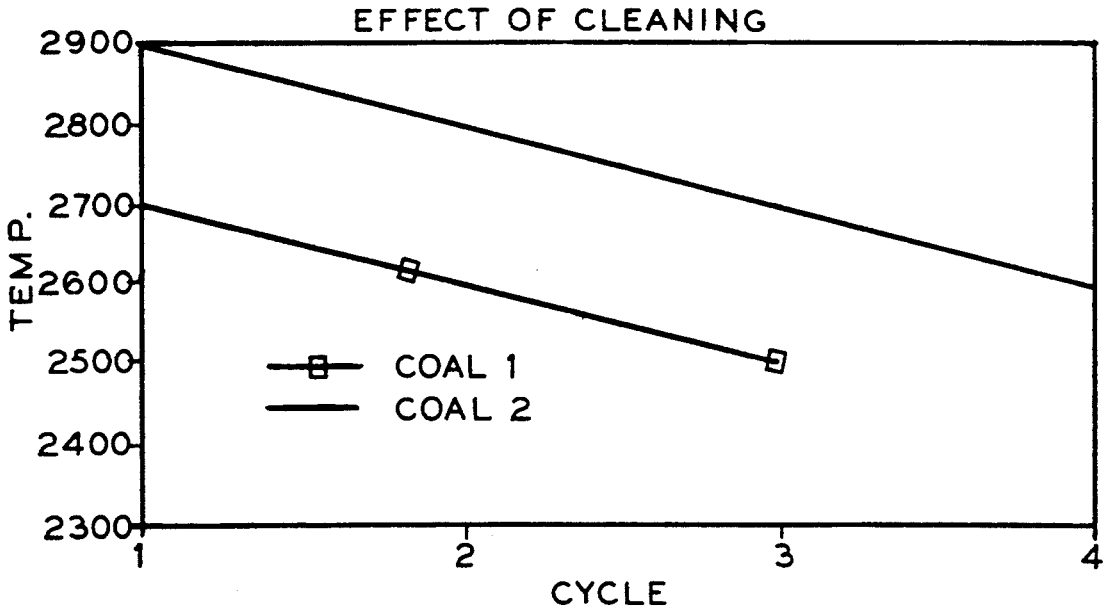
FIG. 9 is a graph illustrating the cleaning test results derived from using the present invention.

FIG. 3 illustrates the variation in $NO_x$ emission with respect to changes in FEGT. These results were obtained on a 600 MW wall fired unit burning bituminous coal. The variations in $NO_x$ were driven by changes in the operating frequency of existing steam wall blowers. FIG. 9 illustrates how FEGT was affected by variation in the operating frequency of the sootblowers.

Figure 10:
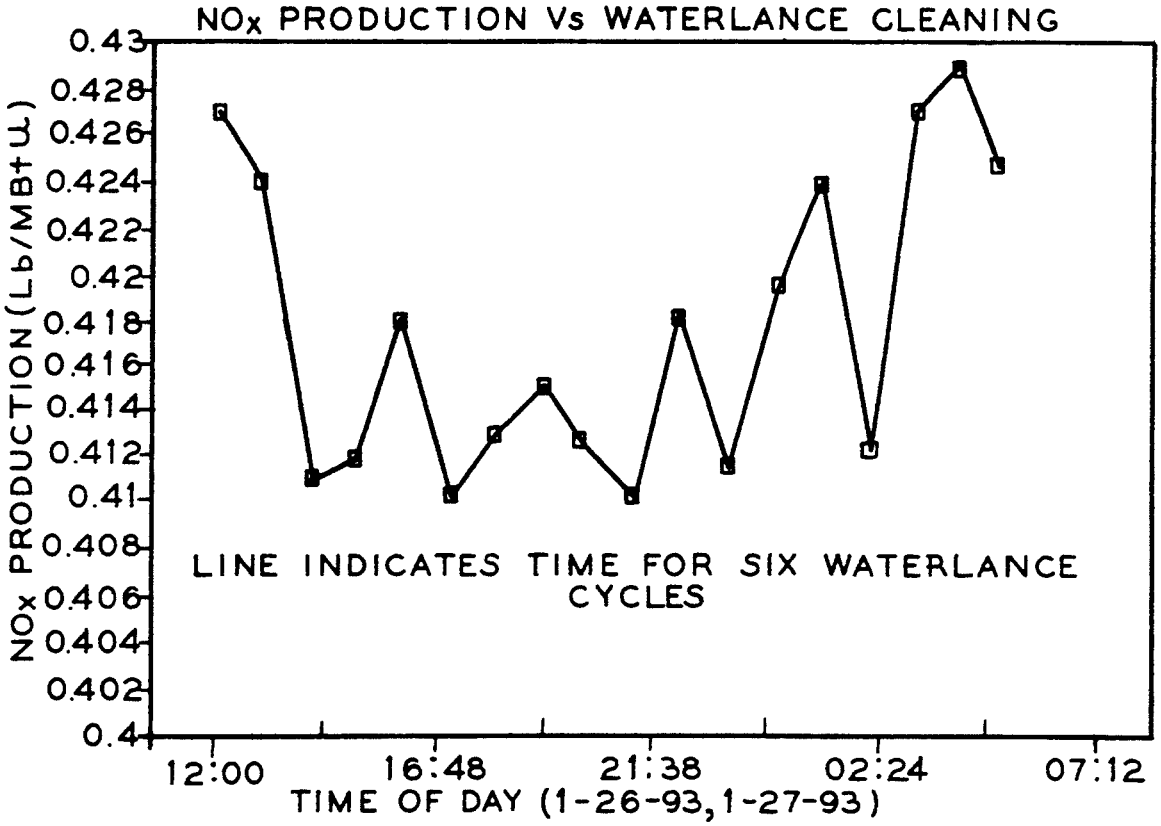
FIG. 10 is a graph plotting $NO_x$ production versus waterlance cleaning.
Figure 11:
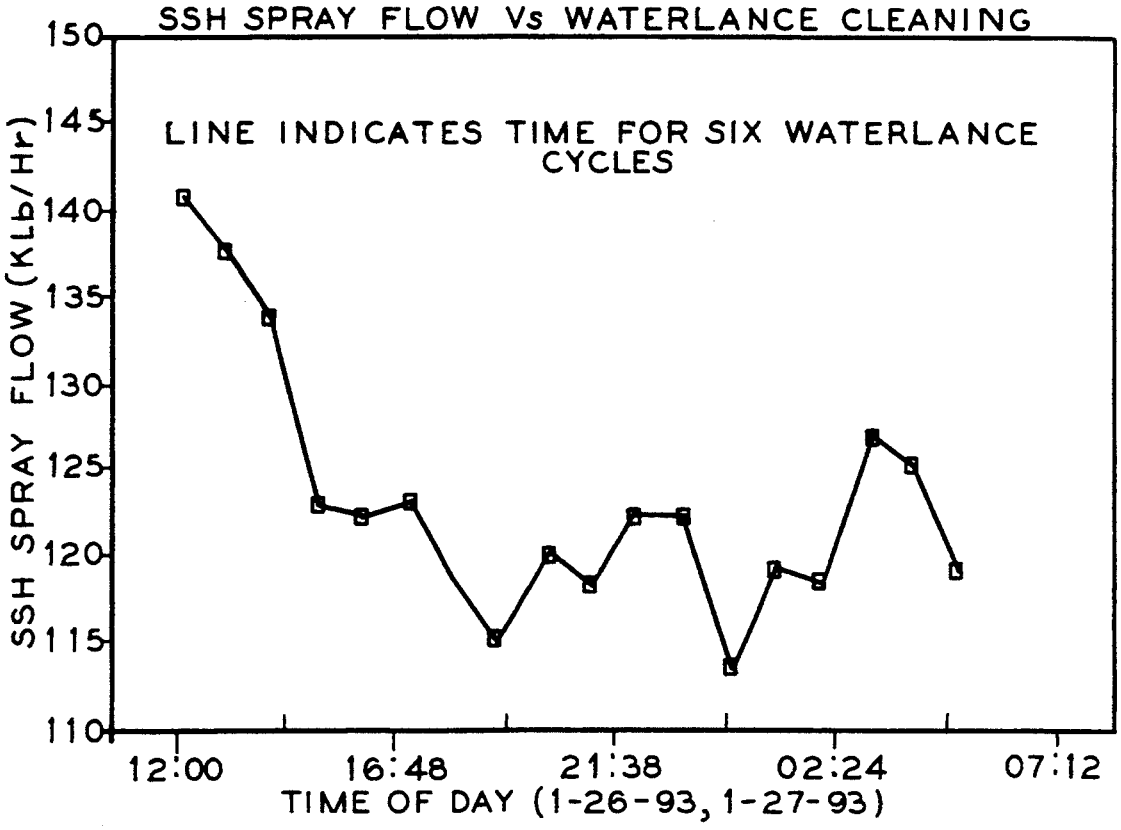
FIG. 11 is a graph plotting spray flow versus waterlance cleaning.

Recent test results from a 400 MW tangential burner oilfired boiler showed similar impact of furnace cleaning on $NO_x$ emissions. This boiler was equipped with a single water lance (provides 180 $ft^2$ cleaning area) for this test. FIG. 10 shows the change in $NO_x$ emissions resulting from 6 back-to-back operations of the test water lance. Direct measurements of furnace surface cleanliness indicated a 100% improvement in heat transfer surface cleanliness. Other measured plant parameters, such as superheater spray flow (FIG. 11) substantiate the measured improvement in heat transfer surface cleanliness. The test results also indicated that the $NO_x$ levels increased as the cleaned heat transfer surface again became dirty.

As shown in FIG. 4, the system maximizes furnace cleaning area and optimizes the effectiveness and impact of both existing cleaning devices and any new cleaning equipment.

An integral part of the condition-based cleaning defined above is a gas temperature sensor. The FEGT information provided by the sensor is vital for driving the cleaning process in order to keep furnace temperatures at the desired level to achieve plant production and minimize $NO_x$ emissions. In operation, the shift operation personnel are able to monitor and control the cleaning process and FEGT from the control operator interface units.

Figure 12:
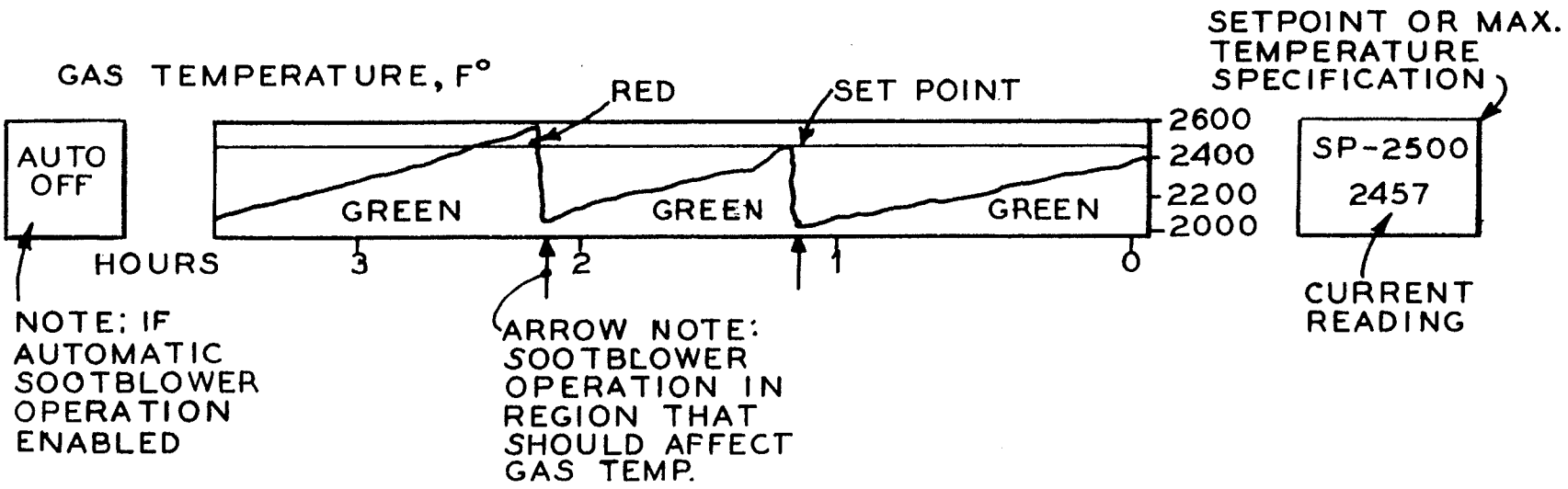
FIG. 12 is an illustration of a temperature trend monitored by the present invention.

FIG. 12 shows a temperature trend which is indicated on the main screen 32 for the system 5 (FIG. 4). From the screen 32, an operator is able to set the furnace cleaning devices 30 (FIG. 4) to an automatic control mode or use the temperature trending in order to allow informed decisions to sootblower operation. In the automatic mode, the furnace cleaning devices 30 are operated to maintain, within defined limits, the desired furnace exit gas temperature.

Combustion management involves dividing the furnace 10 into individual burners or logical combustion segments and verifying the operation of each segment in accordance with a $NO_x$ reduction strategy. The strategy may be derived from the design concept of Low $NO_x$ burners or formulated for other burners based on general $NO_x$ reduction principles. Locations of high $NO_x$ generation are identified and corrected as each segments forward ($NO_x$ formation) reaction rates are minimized and reverse ($NO_x$ destruction or blocking) reaction rates are maximized. Stepwise implementation of combustion management tools and techniques on the logical combustion segments then results in a reduction of the total $NO_x$ generated in the furnace.

Figure 5:
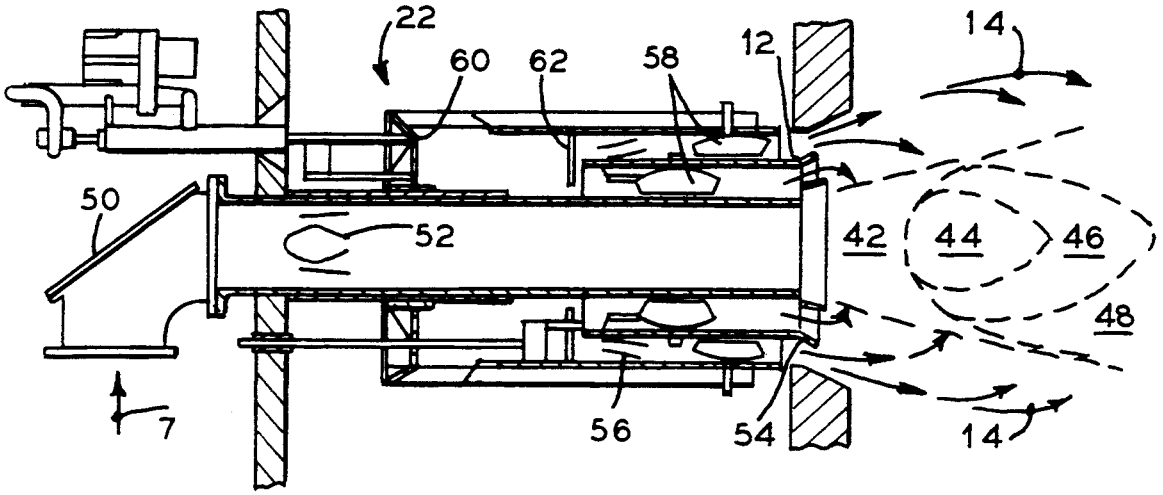
FIG. 5 is a view in cross-section of a burner according to the present invention.

According to the present invention, each segment comprises a burner 22, as shown in FIG. 5, comprising an air separation plate 54 for splitting the burner into an inner concentric ring 12 for supplying secondary air and an outer concentric ring 14 for supplying secondary outer air. The burner 22 includes an inlet 50 for pulverized coal and primary air 7 which is channeled to a conical diffusor 52 which makes up the primary air/coal stream for the burner 22. Both the inner secondary air path 12 and the outer secondary air path 14 have independently adjustable spin vanes 58 acting from a 0° angle (closed) to a 90° angle (fully opened, no spin). The burner 22 also includes a sliding air damper 60, and air measuring device 62 for measuring air through the burner 22 and fixed spin vanes 56.

According to the present invention, the burner 22 has a high temperature fuel-rich devolatilization zone 42. A production of reducing species zone 44 follows the high temperature zone 42. $NO_x$ is decomposed in an $NO_x$ decomposition zone 46 outside of the reducing area 44; and the $NO_x$ zone 46 is followed by a char oxidizing zone 48.

Tests were conducted using the burner 22 wherein the results are described below. In these tests, the larger the vane position number, the greater the vane opening angle. The same position number for the inner and outer vanes correspond to equal angle settings.

Figure 6:
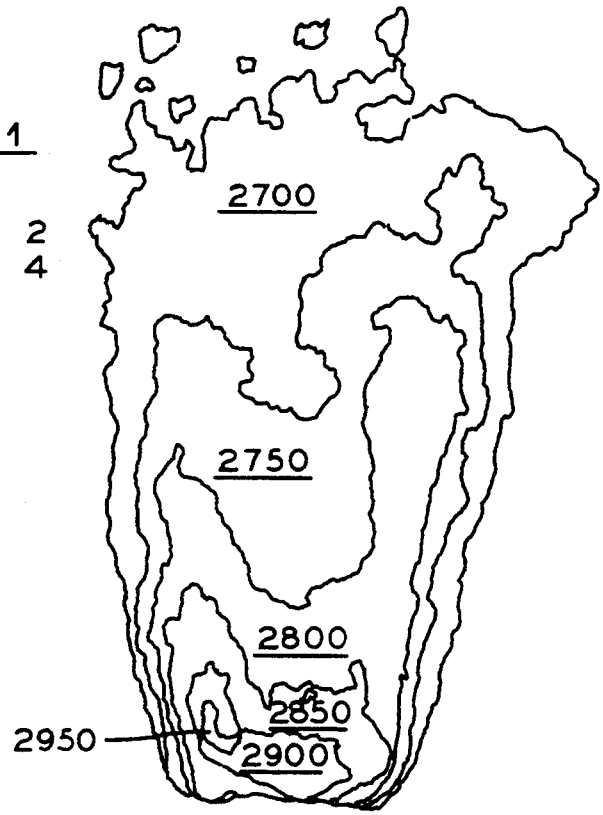
FIG. 6 is an illustration of the results of a first burner test.

As shown in FIG. 6, the temperature contours from a flame camera, placed above the flame for an inner vane position of 2 and an outer vane position of 4, show the characteristics of good staged combustion within a cell burner. A small volume hot zone exists at the region of coal devolatilization where a fuel rich condition can be expected. Notice that this hot zone peaks at only 2950° F. and the 2900° F. volume is small. This is followed by a rapid cooldown as secondary air increases the oxygen concentration downstream. Recirculation is evident by the folding inward of the contours as the air swirls back into the rear of the flame.

Figure 7:
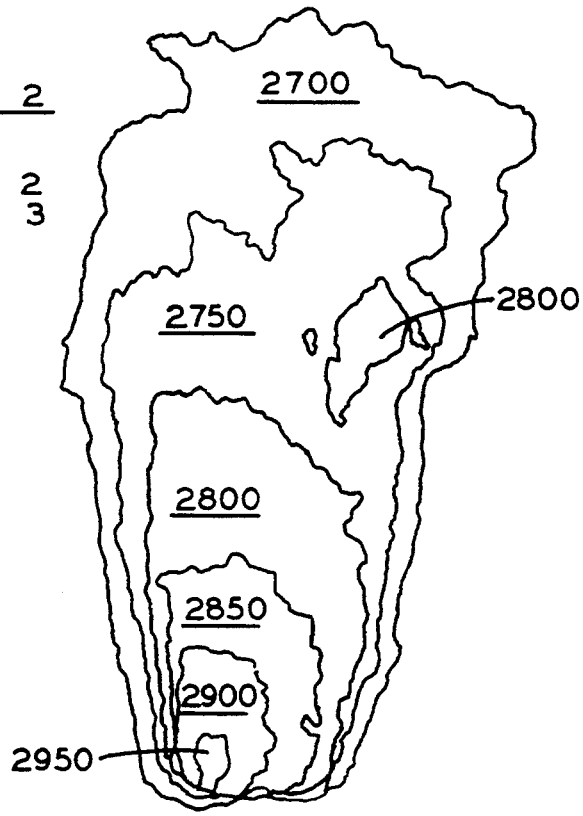
FIG. 7 is an illustration of the results of a second burner test.

FIG. 7 presents data for an inner vane setting 2, same as FIG. 6, and an outer setting of 3 (reduced angle). The temperature contours form the camera are quite similar to the first case in that temperature ranges and volumes are about the same. The principle difference between the two is the strength of the recirculation evidenced by the contours. Comparing the 2800° F. and the 2750° F. contours between the two temperature plots, the 3 outer vane position has a slight rounded folding of the contours compared to the deep folding of the position 4 setting. Also, the general shape of all the contours is more circular. However, the temperature gradient is still steep and the $NO_x$ value has only increased from 220 to 228 ppm. The $O_2$ at the stack was decreased for this case indicating that the flattening of the vane setting was not yet fully compensated for by the operator adjusting the fan current before the data was recorded. The data provided here was taken as the mean from a strip chart for the test condition over a period after the system had stabilized at the new settings.

Figure 8:
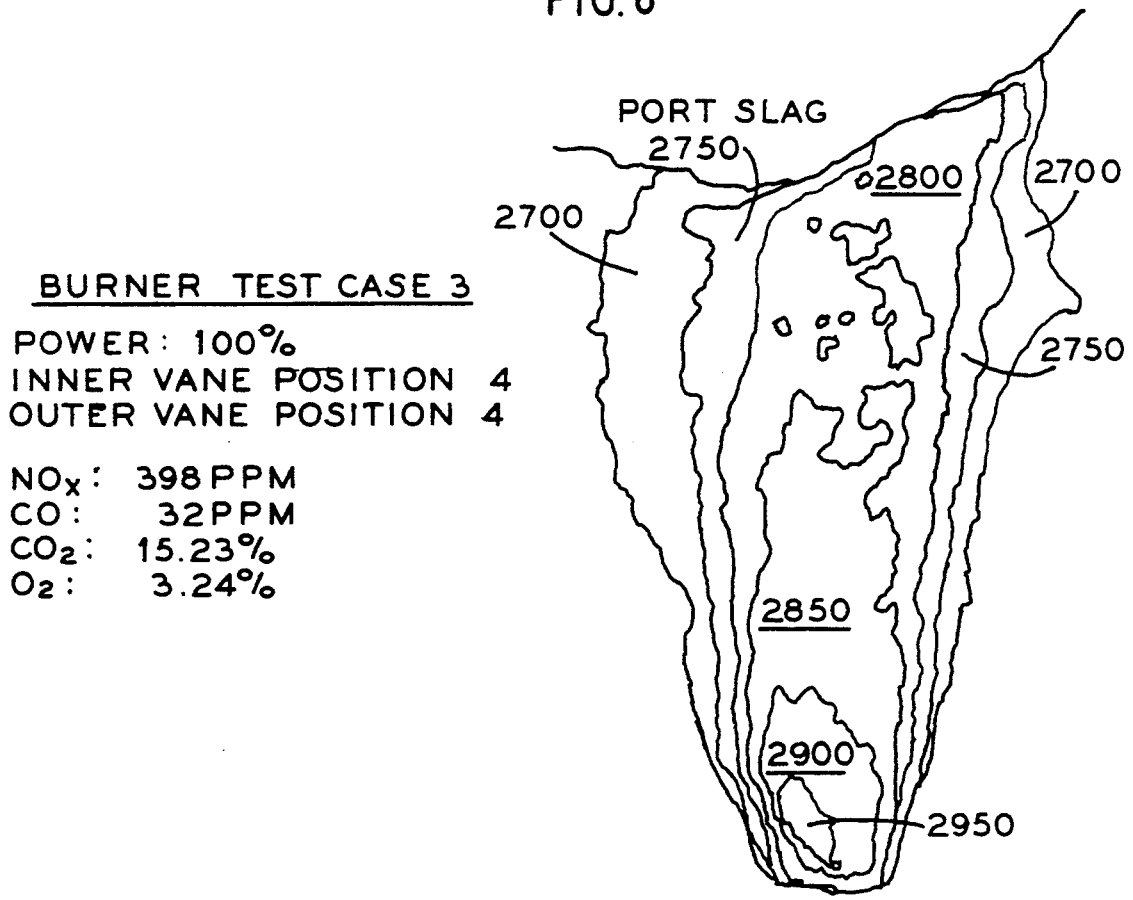
FIG. 8 is an illustration of the results of a third burner test.

FIG. 8 shows the results for an inner vane and outer position of 4. Opening of the inner vane proportions more air into the core of the flame. This increases oxygen concentration in the region of the nitrogen based intermediate reactions resulting in NO vice $N_2$ formation. Coincident angles with relatively mild spin decreases turbulence and results in a longer tubular vice wedge shaped flame. While the peak temperature is the same as in FIG. 6, at 2950° F., the 2900° F. volume is larger, and the 2850 and 2800 regions are much larger. These high temperatures are carried back to an area of the flame where oxygen concentrations are high resulting in the generation of oxygen radicals to the fuel the Zel'dovich mechanism. Between the increased volatile fuel $NO_x$ and thermal $NO_x$ formations the measured $NO_x$ has increased from the value presented in FIG. 6 of 220 ppm to a value of 398 ppm while the other exit gas conditions are nearly the same. An additional case with the inner vane opened further proportioned more flow to the flame core. This produced the highest $NO_x$ level of 461 ppm.

While a specific embodiment of the invention has been shown and described in detail to illustrate the application of the principles of the invention, it will be understood that the invention may be embodied otherwise without departing from such principles.

What is claimed is:

1. A method for controlling nitrogen oxide ($NO_x$) levels in a gas produced by a fossil fuel fired unit, the method comprising:

establishing an optimum gas temperature range for the unit;

monitoring a gas temperature of the unit;

cleaning the heat exchanger surfaces of the unit until the monitored gas temperature is within the optimum gas temperature range;

establishing an optimum fuel combustion rate range for the unit;

monitoring a fuel combustion rate of the unit; and providing air to the unit until the monitored fuel combustion rate is within the optimum fuel combustion rate range.

2. The method according to claim 1, including establishing combustion segments for the unit.

3. The method according to claim 2, wherein a fuel combustion rate is monitored for each segment and air is provided to each segment of the unit until the monitored fuel combustion rate is within the optimum fuel combustion rate range.

4. The method according to claim 2, wherein each segment comprises a burner.

5. The method according to claim 1, wherein the heat exchanger surfaces of the unit are cleaned by blowers.

6. The method according to claim 1, wherein the heat exchanger surfaces of the unit are cleaned by water.

7. A system for controlling nitrogen oxides ($NO_x$) levels in a gas produced by a fossil fuel fired unit having heat exchanger surfaces, the system comprising:

burning means in the unit for burning the fuel at a combustion rate;

air means for providing air to the unit;

cleaning means for cleaning the heat exchanger surfaces of the unit; and monitoring means for setting an optimum combustion rate range for the unit and for measuring the combustion rate produced by the burning means, the monitoring means communicating with the air means for adjusting the measured combustion rate within the combustion rate range by providing air to the unit, the monitoring means also for setting an optimum gas temperature range for the unit and for measuring a gas temperature of the unit, the monitoring means also communicating with the cleaning means for adjusting the gas temperature of the unit within the optimum gas temperature range by cleaning the heat exchanger surfaces of the unit.

8. The system according to claim 7, wherein monitoring means comprises a gas temperature sensor in the unit.

9. The system according to claim 8, wherein the monitoring means further comprises a combustion rate sensor in the unit.

10. The system according to claim 9, wherein the monitoring means further comprises display means for displaying temperatures and combustion rates.

11. The system according to claim 9, wherein the cleaning means comprises at least one blower in the unit.

12. The system according to claim 9, wherein the cleaning means further comprises at least one water lance.

13. The system according to claim 7, wherein the burning means comprises at least one burner.

* * * * *